US005853117A

United States Patent [19]

Traise

[11] Patent Number: 5,853,117

[45] Date of Patent: Dec. 29, 1998

[54] SEPARATOR FOR LINERLESS LABELS

[75] Inventor: John E. Traise, Melbourne, Fla.

[73] Assignee: Moore Business Forms, Inc., Grand Island, N.Y.

[21] Appl. No.: 550,622

[22] Filed: Oct. 31, 1995

[51] Int. Cl.[6] ..... B26F 3/00

[52] U.S. Cl. ..... 225/4; 225/100; 83/168; 83/340; 83/371; 83/672

[58] Field of Search ..... 225/100, 4; 83/340, 83/168, 672, 169, 610, 611, 371

[56] References Cited

U.S. PATENT DOCUMENTS

| | | | |
|---|---|---|---|
| 2,285,228 | 6/1942 | Potdevin | 225/4 |
| 3,543,623 | 12/1970 | Wirstroem | 83/169 |
| 3,606,813 | 9/1971 | Hallden | 83/672 |
| 3,658,614 | 4/1972 | Beck | 83/610 |
| 3,754,370 | 8/1973 | Hanson | 225/100 |
| 3,813,976 | 6/1974 | Greer | 83/611 |
| 3,822,625 | 7/1974 | Obenshain | 83/672 |
| 4,284,221 | 8/1981 | Nagel et al. | 225/100 |
| 4,519,868 | 5/1985 | Hoffman | 83/371 |
| 4,529,114 | 7/1985 | Casper et al. | 225/4 |
| 4,572,686 | 2/1986 | Tanaka | 83/371 |
| 4,574,817 | 3/1986 | Suzuki et al. | 83/168 |
| 4,630,514 | 12/1986 | Ohmori et al. | 83/672 |
| 4,688,708 | 8/1987 | Irvine et al. | 225/100 |
| 4,978,415 | 12/1990 | Jones | 83/168 |
| 4,997,119 | 3/1991 | Meschi | 225/100 |
| 5,141,142 | 8/1992 | Ramsey | 225/4 |
| 5,167,301 | 12/1992 | Cappi et al. | 225/100 |
| 5,241,884 | 9/1993 | Smithe et al. | 83/371 |
| 5,279,195 | 1/1994 | Breton | 83/610 |
| 5,470,300 | 11/1995 | Terranova | 83/371 |
| 5,540,369 | 7/1996 | Boreali et al. | 225/4 |
| 5,573,621 | 11/1996 | Boreali | 225/100 |

*Primary Examiner*—M. Rachuba
*Assistant Examiner*—Sean A. Pryor
*Attorney, Agent, or Firm*—Nixon & Vanderhye, P.C.

[57] ABSTRACT

Linerless labels are cut or burst from a web by passing the web through infeed and outfeed pairs of rolls with a separator device located therebetween. Each roll pair includes a friction surface for engaging the slick smooth surface of the web and another roll with a silicone elastomeric or plasma-coated surface for engaging substantially without gripping the exposed adhesive side of the linerless label web. In the cutting mode, a rotary blade severs the web against a fixed blade to form the label. The infeed rolls are backed up after each cut to break the adhesive bond between the web and the fixed blade and then reverse to advance the web through the cutting position and into the outfeed rolls for a subsequent cutting operation. The outfeed rolls continue to advance the cut linerless label to a receiving station. In a bursting mode, the web is perforated and a roller breaker bar is disposed between the infeed and outfeed rolls to break the web along the perforations to form the linerless label.

13 Claims, 3 Drawing Sheets

SEPARATOR FOR LINERLESS LABELS

TECHNICAL FIELD

The present invention relates to a handling system for linerless labels and particularly relates to a cutting or bursting system for separating linerless labels with exposed adhesive on one side from a web thereof.

BACKGROUND

There are many prior art pieces of equipment for detaching or bursting continuous business forms in general (see, for example, Reissue Pat. No. 30,398 and U.S. Pat. No. 3,741,451), as well as apparatus for bursting conventional labels with release sheets from a fanfolded stack, such as illustrated in U.S. Pat. Nos. 5,100,040 and 4,375,189. Separating linerless labels, however, from a web of labels with the adhesive exposed along one side and a slick surface on the opposite side presents different problems and the typical equipment for detaching or bursting continuous business forms or bursting conventional labels with release sheets is not appropriate for detaching linerless labels.

DISCLOSURE OF THE INVENTION

According to the present invention, there is provided a separation device for processing linerless labels from a web typically emanating from a roll of linerless label material, the web having adhesive exposed along one side and a slick surface along the opposite side. The mechanism of the present invention forms the label from the web by a cutting or bursting operation. In either mode, the cut or burst position is controlled by a preprinted timing mark on the label web. For example, when cutting, the timing mark on the web controls the cut line position. When bursting successive labels from the web, the timing mark is used to initiate the bursting mechanism. Thus, the web of labels is preprinted with a timing mark and, in the case of bursting, is additionally preperforated in synchronization with the timing mark. Note that marginal punchings are not used with the label stock or with the separation mechanism to advance the web through the mechanism.

Generally, the separating mechanism hereof includes a pair of infeed rolls which are maintained in pressure contact with the label web passing through the nip of the rolls. The upper roll is a high friction elastomer or grit roll for positively contacting the slick surface of the label web, while the lower roll has either a silicone elastomer-covered or non-stick plasma-covered surface which is non-cohesive with the adhesive side of the label web. The infeed rolls are driven by a first motor responsive to a controller which, upon reading the timing mark, stops the infeed rolls in position for the cutting operation. A pair of outfeed rolls, disposed downstream from the infeed rolls, are operated by a second motor independently of the first motor driving the infeed rolls. Between the infeed and outfeed roll pairs is a cutting mechanism comprised of a cylinder mounting a transversely extending blade, preferably in a slight helix orientation relative to the axis of the cylinder, and mounted on one side of the web preferably in opposition to the slick upper side of the web. A fixed cutting blade lies preferably on the opposite side of and below the web. The cylinder-mounted cutting blade may rotate a full 360° to cut the web or may be oscillated between successive cuts through the web. In either case, the web is cut from one side edge to the other because of the helix configuration of the movable blade. A wicking roll is provided to oil the movable blade and prevent the build-up of adhesive along the blades.

In operating the separator mechanism of the present invention in a cutting mode, the infeed and outfeed rolls are driven in synchronism and the movable cutting blade rotates in position to effect the cut through the web from one side edge to the opposite side edge. To cut, the infeed and outfeed rolls are stopped in a position locating the web for a transverse cut at a predetermined longitudinal location along the web in alignment with the fixed blade. Following the cut, the infeed rolls are backed or reversed to a slight degree to break the fugitive adhesive bond of the web from the fixed blade of the cut-off mechanism, while the outfeed roll pair are advanced forwardly to discharge the cut label. Alternatively, both infeed and outfeed rolls may be stopped after the cut to hold the cut label in cut position and then the outfeed rolls can be programmed to rotate at a second rotational speed, effecting a clean transfer of the severed label to a receiving device and without the need for cooperation with the infeed pair of rolls. While the cut cylinder may rotate 360°, an alternative form of the invention provides for the cut cylinder to oscillate between a home position and a cut position.

In a bursting mode, and instead of a rotary pivotal cylindrical cutter roll with a cutting blade, a smooth breaker bar is used in conjunction with the perforated web. The outfeed rolls can be accelerated upon sensing the timing mark to effect separation of the labels along the perforations against the breaker bar.

In a preferred embodiment according to the present invention, wherein there is provided a separator having a pair of infeed rolls with a nip therebetween, a pair of outfeed rolls with a nip therebetween and a separating member between the pairs of rolls, a method of separating linerless labels disposed in a web wherein the web has a first surface that will not readily adhere to adhesive on a second surface thereof, comprising the steps of (a) advancing a leading portion of the web through the nips of the infeed and outfeed pairs of rolls in a first direction and past the separating member between the pairs of rolls with the second surface facing away from the separating member as the web moves in the first direction, (b) sensing timing marks on the web and (c) sequentially separating the web into linerless labels by moving the separating member to engage the web in response to periodically sensing the timing marks.

In a further preferred embodiment according to the present application, there is provided apparatus for detaching linerless labels from a web having a slippery surface coating on one side and an adhesive coating exposed along its opposite side comprising a pair of infeed rolls rotatable about parallel axes and forming a nip therebetween, with at least one roll thereof having a high friction surface for engaging the slippery coated side of the web and another roll thereof having a substantially non-stick surface for contact with the adhesive coating of the web, a pair of outfeed rolls rotatable about axes parallel to one another and to the axes of the infeed rolls with at least one roll thereof having a substantially non-stick surface for contact with the adhesive coating, a separation device between the pairs of infeed and outfeed rolls for separating the web into linerless labels, a sensor for sensing a mark on the web and providing an output signal in response thereto and means responsive to the output signal for actuating the separation device for forming the linerless labels.

Accordingly, it is a primary object of the present invention to provide a novel and improved separator mechanism for separating linerless labels from a web thereof in a manner which achieves higher throughput, improved reliability and longer life for the system.

BEST MODE FOR CARRYING OUT THE INVENTION

Figure 1:
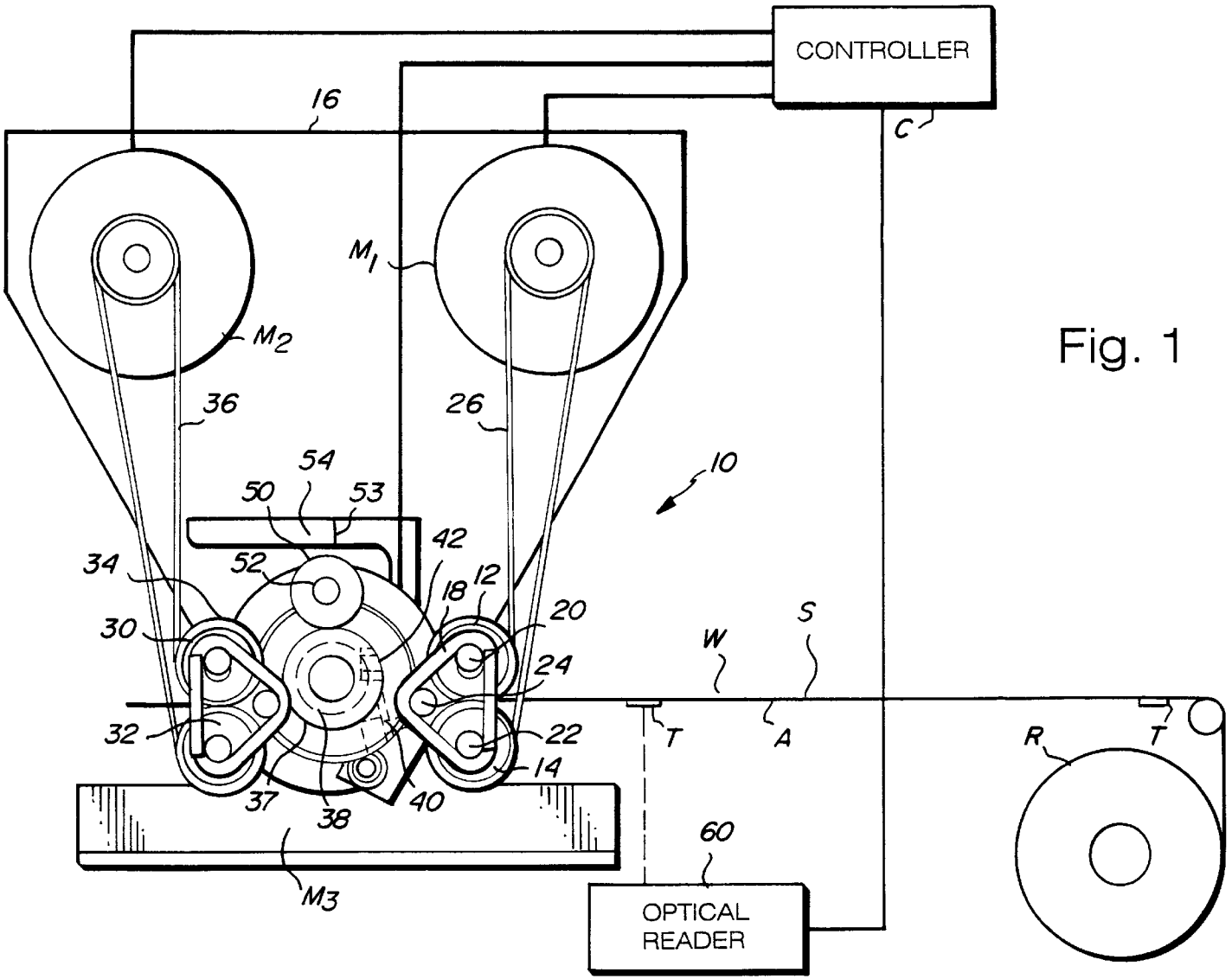
FIG. 1 is a schematic side elevational view of a separator according to the present invention.
Figure 2:
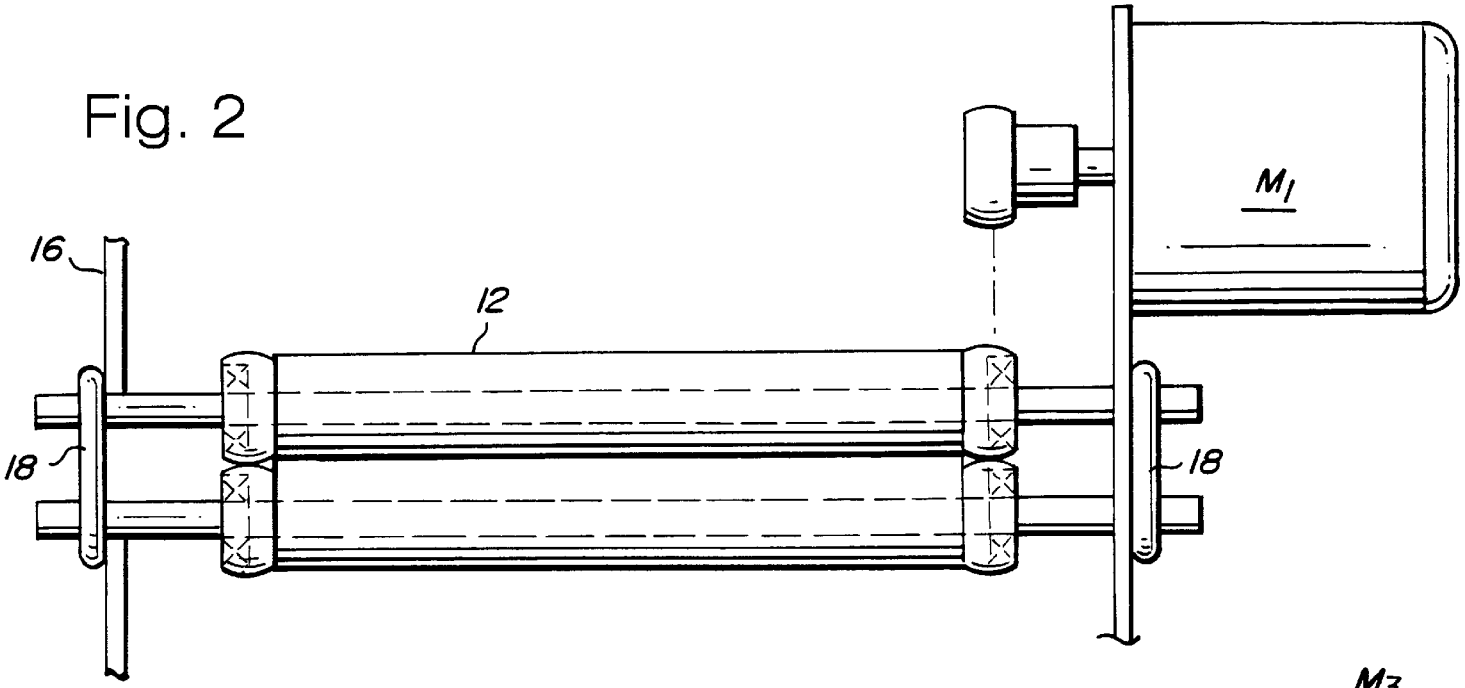
FIG. 2 is a schematic end elevational view of the infeed rolls.

Referring now to the drawings, particularly to FIG. 1, there is illustrated a separator, generally designated 10, according to the present invention, for forming discrete linerless labels from a web W of label material. The separator may be employed in a cutting mode or in a bursting mode. In either mode, the web of labels is provided with preprinted timing marks T along one side for purposes of controlling the cutting or bursting position of the web, as will become apparent from the ensuing description. Thus, the timing marks are used to initiate the separating mechanism. In the bursting mode, the web W of labels has transversely extending lines of perforation which are severed on bursting to form discrete linerless labels. As illustrated, the web W is preferably taken from a roll R of web material. The web, as illustrated, has an exposed adhesive surface A along its underside and a slippery surface, i.e., a silicone-coated surfaces, along its upper side. The slippery surface does not readily adhere to the adhesive surface when the web is in roll form. As indicated previously, marginal punching is not used with the label stock.

The separator mechanism 10 includes a pair of input rolls 12 and 14 defining a nip through which the web W is passed. The rolls are mounted for rotation between a pair of opposed frames 16, only one being illustrated in FIG. 1, and are maintained in pressure contact with web W by means of a garter spring 18. Spring 18 extends about the end axles 20 and 22 of the rolls 12 and 14, respectively, and a dead post 24. The dead post 24 retains the spring on the assembly while facilitating removal of either roll 12 or 14 for jam clearance or cleaning. As illustrated, a motor M1 is mounted on a side frame 16 and includes a pulley or belt 26 for connection with the rollers 12 and 14 for driving the rollers in forward and reverse directions as described below. The upper roll 12 preferably has high friction elastomer or grit roll surface for effecting positive contact with the slick silicone-coated side of the web W. The lower roll 14 has either a silicone elastomer or a non-stick plasma surface, both of which effect little or no cohesion with the adhesive A along the underside of the label web W. It will be appreciated that the orientation of the web and infeed rolls can be reversed with the adhesive on top of the web in contact with the roll 14 and the slick surface on the bottom of the web in contact with the roll 12.

A pair of outfeed rolls 30 and 32 are similarly positioned downstream from the infeed rolls 12 and 14 and define a nip between which the cut labels are advanced for dispensing from the separator 10. The rolls 30 and 32 are mounted similarly as the infeed rolls, employing a garter spring 34. The outfeed rolls 30 and 32 are driven by a separate motor M2 through a pulley arrangement 36. The rolls 30 and 32 are of substantially identical construction with the rolls 12 and 14, respectively, of the infeed rolls.

Figure 3:
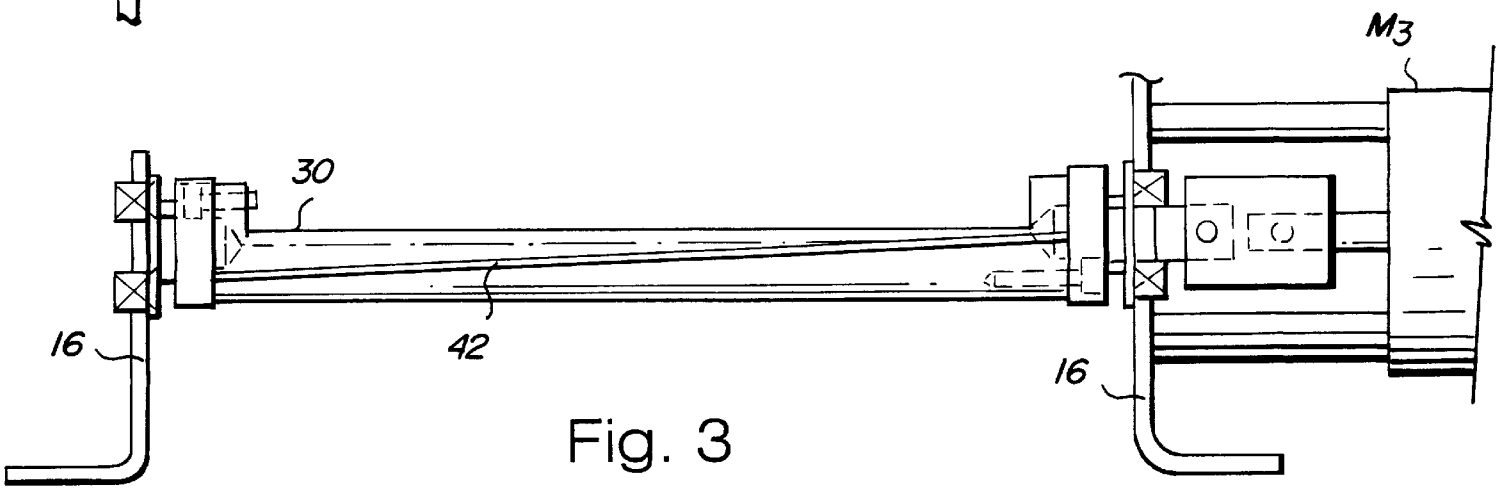
FIG. 3 is an end elevational view illustrating the cutting mechanism on a cut roller.
Figure 4:
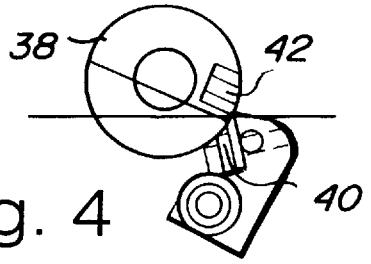
FIGS. 4 and 5 are illustrative of the helically oriented cutting blade at the beginning and end of the cut, respectively.
Figure 5:
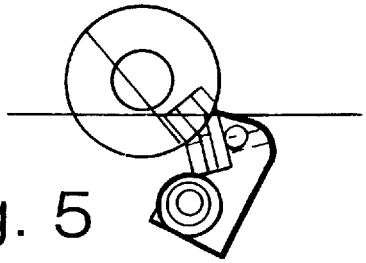
Figure 6:
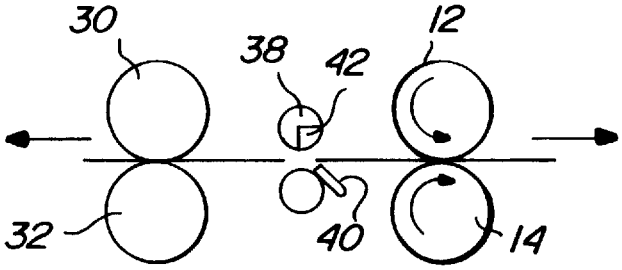
FIG. 6 is a schematic illustration of the infeed rolls backing up to break the fugitive adhesive bond between the cut label and the web.

Between the infeed rolls and the outfeed rolls, there is provided a cylinder assembly 37 on which is mounted a fixed blade 40 in opposition to a cylinder 38 carrying a blade 42 movable with the cylinder 38. The blade 40 serves as a fixed anvil in opposition to the movable blade 42, the fixed and movable blades 40 and 42 extending along the underside and upper sides of the web W, respectively. Cylinder 38 is mounted for rotation about an axis in the opposite supporting walls 16 and is driven by a separate motor M3. As illustrated in FIG. 3, movable blade 42 forms a helix angle with the axis of rotation of cylinder 38. Consequently, the cutting proceeds with the cooperation of movable and fixed blades 42 and 40, respectively, from the high end of the blade (the left side of FIG. 3) to the low end of blade 42 (the right side of blade 42 in FIG. 3), assuming clockwise rotation of the cylinder 38 in FIG. 1. Thus, cutting is effected from one side edge of the web to its opposite side edge, with low incremental cutting pressure against the label being severed. Thus, discrete rotation of the cylinder 38 from a home position illustrated in FIG. 1 through an initial cut position illustrated in FIG. 4 to the complete cut position illustrated in FIG. 5 is necessary to effect a through-cutting of the web.

The cylinder 38 is mounted for complete 360° rotation which facilitates the oiling of the blade by a wicking cylinder 50. The wicking cylinder includes a felt roll assembly 52 having an outside diameter which slightly interferes with the periphery of the rotary blade 42 as it sweeps past the felt roll 52. The felt roll 52 is supported on ball bearings, not shown and is not driven. Oiling is accomplished by a series of oil drip positions comprising passages 53 through a top bar 54. Alternatively, the cylinder 38 may be mounted for oscillatory motion about its axis. Oscillatory motion is preferred for improved cycle times where label lengths are relatively short.

As illustrated in FIG. 1, there is provided an optical reader 60 for sensing the timing marks T as they pass a predetermined position. An output signal from the optical reader 60, responsive to sensing a timing mark, is input to a controller C which, in turn, controls the operation of motors M1, M2 and M3.

With the web W in the position illustrated in FIG. 1 extending between the nips of both the infeed and outfeed roll pairs, the roll pairs are driven in synchronism by motors M1 and M2, respectively. Upon sensing the passage of a timing mark T, the controller stops the motors M1 and M2 so that the cut cycle may proceed. With the motor M3 rotating the cut cylinder 38 through 360° or oscillating the movable blade 42, the blade 42 cooperates with the fixed blade 40 to sever the web W at a location providing a predetermined length of cut label. Following the cut, the motor M1 is reversed by the controller C. This reverses or backs up the infeed rollers 12 and 14 to break the fugitive bond of the advancing web W from the fixed blade 40, while the outfeed rolls are again advanced by operation of motor M2 to discharge the cut label from the separator 10. Once the fugitive bond is broken, the motor M1 reverses direction to rotate the infeed rolls in a direction to advance the web W through the cutting assembly and the outfeed rolls. Thus, the outfeed rolls may be driven at one rotational speed for infeeding, matching the speed of the infeed rolls, braked to then hold the cut label in its cut position and rotated at a second rotational speed following cut-off to effect clean transfer of the severed label to a receiving means, not shown, and without the need to cooperate with the infeed rolls 12 and 14. By independently controlling the motors M1 and M2, the infeed and outfeed rolls can be advanced essentially on demand for predetermined intervals as desired.

Figure 7:
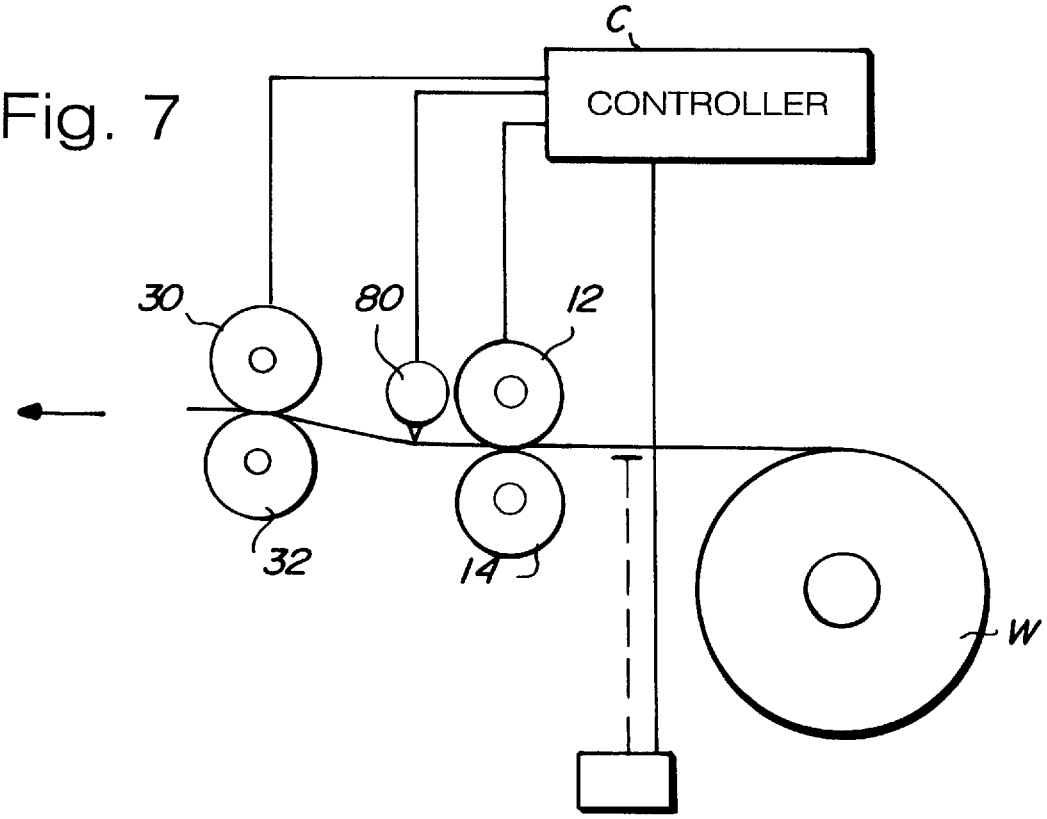
FIG. 7 is a schematic illustration of a separator hereof in a bursting mode.

In the bursting mode of operation as illustrated in FIG. 7, essentially the same basic mechanism is employed. In the bursting mode, however, a breaker bar 80 is substituted for the rotatable blade. The fixed blade 40 may remain in place or be replaced with a smooth edged arbor, not shown against which the advancing web would impinge, while the rotary breaker bar processes to effect separation. In this form, however, the web is manufactured with transversely extending perforations such that the discrete labels are formed by breaking the perforations separating the label from the web. In the bursting operation, the movement of the web need not be stopped when forming each discrete label. That is, the bursting operation may be continuous. Additionally, the bursting operation may use the controller to speed up the outfeed rolls once the timing mark has been sensed to effect bursting of the label from the web along the line of perforations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a separator having a pair of infeed rolls with a nip therebetween, a pair of outfeed rolls with a nip therebetween and located downstream of the pair of infeed rolls in a direction of travel of a web through the nips of said pairs of infeed and outfeed rolls, and a separating member downstream of said pair of infeed rolls and upstream of said pair of outfeed rolls, method of separating linerless labels forming said web wherein the web has a first surface that will not readily adhere to adhesive on a second surface thereof, comprising the steps of:

(a) advancing a leading portion of the web of linerless labels with the first surface not readily adherent to adhesive and said second surface having adhesive thereon on opposite sides of the web, through the nips of the infeed and outfeed pairs of rolls in a first downstream direction and past the separating member with the second surface having adhesive thereon facing away from the separating member as the web moves in the first downstream direction;

(b) sensing timing marks on the web disposed along one of said surfaces thereof; and (c) sequentially separating the web into linerless labels by moving the separating member to engage the web in response to periodically sensing the timing marks.

2. A method according to claim 1 wherein the labels of the web are separated by lines of perforation and wherein step (c) includes bursting the labels between the infeed and outfeed pairs of rolls along the lines of perforations by moving the separating member.

3. A method according to claim 1 wherein the separation member includes a cutting blade mounted for movement about an axis and has a length at least as great as the width of the web of labels and wherein step (c) includes cutting the web by displacing the cutting blade about said axis to cut discrete labels from the web.

4. A method according to claim 3 including rotating the cutting blade substantially one complete revolution between sequential cuts along the web.

5. A method according to claim 3 including oscillating the cutting blade about said axis between successive cuts along the web.

6. A method according to claim 3 including engaging the cutting blade against a wicking element to clean the blade, thereby at least minimizing adhesive build-up from the labels on the blade.

7. A method according to claim 3 including stopping the advancing web prior to cutting the web to form each linerless label.

8. A method according to claim 7, wherein the separator includes a fixed cutting blade, and further including the step of, following cutting the web to form a label, reversing the direction of rotation of the infeed rolls to displace the web relative to a fixed cutting blade in a second upstream direction opposite said first downstream direction to break any fugitive bond of adhesive between the cut web and said fixed blade.

9. A method according to claim 8 including, while said web is being displaced in said second upstream direction, operating the outfeed pair of rollers to advance a cut label in said first downstream direction.

10. A method according to claim 3 wherein the separator includes a fixed cutting blade and the movable blade has a helix angle about said axis, and including the further steps of stopping the web prior to cutting the web and progressively cutting the web from one side edge thereof to an opposite side edge and against said fixed blade by moving the helically mounted blade about said axis.

11. A method according to claim 1 including providing one roll of said infeed pair of rolls with a high friction surface for engaging the non-adhesive adherent surface of the web and on another roll of said infeed pair of rolls with a substantially non-stick surface for contact with the adhesive surface of the web, and providing one roll of said outfeed pair of rolls with a substantially non-stick surface for contact with the adhesive surface.

12. A method according to claim 1 including moving said separating member toward and away from the web to burst the web along lines of perforations to form discrete linerless labels.

13. A method according to claim 1 including sensing the timing marks on the web at a location therealong upstream of the outfeed rolls and before movement of the separating member.

* * * * *